US007682469B2

(12) United States Patent
Ikuno et al.

(10) Patent No.: US 7,682,469 B2
(45) Date of Patent: Mar. 23, 2010

(54) PISTON MADE OF ALUMINUM CAST ALLOY AND METHOD OF MANUFACTURING THE SAME

(75) Inventors: Hajime Ikuno, Owariasahi (JP); Yoshihiko Sugimoto, Nagoya (JP); Hiroshi Hohjo, Nagoya (JP)

(73) Assignee: Kabushiki Kaisha Toyota Chuo Kenkyusho, Aichi-gun (JP)

( * ) Notice: Subject to any disclaimer, the term of this patent is extended or adjusted under 35 U.S.C. 154(b) by 201 days.

(21) Appl. No.: 10/620,388

(22) Filed: Jul. 17, 2003

(65) Prior Publication Data

US 2004/0057865 A1 Mar. 25, 2004

(30) Foreign Application Priority Data

Jul. 22, 2002 (JP) ..... 2002-212773

(51) Int. Cl.
*C22C 21/04* (2006.01)
*C22F 1/043* (2006.01)

(52) U.S. Cl. ..... 148/417; 148/549; 420/535; 420/551

(58) Field of Classification Search ..... 148/549, 148/417, 700; 420/551, 535, 548, 549
See application file for complete search history.

(56) References Cited

U.S. PATENT DOCUMENTS 4,434,014 A * 2/1984 Smith ..... 148/549
5,162,065 A 11/1992 Scott et al.

FOREIGN PATENT DOCUMENTS

| | | |
|---|---|---|
| DE | 670 570 | 1/1939 |
| DE | 10 97 693 | 1/1961 |
| DE | 41 03 934 | 8/1992 |
| EP | 0 924 310 B1 | 9/2001 |
| JP | 01-180938 | 7/1989 |
| JP | 5-179383 | 7/1993 |
| JP | 08 104937 | 4/1996 |
| RU | 2092604 C1 * | 10/1997 |
| WO | WO 0071772 A1 * | 11/2000 |

OTHER PUBLICATIONS

"ASM Handbook: vol. 15 Casting", ASM International, 1988, p. 743-760.*
"Aluminum Stantdards and Data 2003", Aluminum Association, Inc., 2003, p. 1-6.*

* cited by examiner

*Primary Examiner*—Roy King
*Assistant Examiner*—Janelle Morillo
(74) *Attorney, Agent, or Firm*—Oblon, Spivak, McClelland, Maier & Neustadt, L.L.P.

(57) ABSTRACT

A piston made of aluminum cast alloy having a main body section in an approximately cylindrical shape, atop face section provided and arranged so as to occlude one end of the main body section, and a pin boss section in which a pin hole is provided so as to penetrate through the main body section in a radial direction. The piston comprises an aluminum cast alloy containing Mg (Magnesium): equal to or less than 0.2 mass %, Ti (Titanium) 0.05-0.3 mass %, Si (Silicon): 10-21 mass %, Cu (Copper): 2-3.5 mass %, Fe (Iron): 0.1-0.7 mass %, Ni (Nickel): 1-3 mass %, P (Phosphorus): 0.001-0.02 mass %, Al (Aluminum): the remaining portions, and impurities.

9 Claims, 9 Drawing Sheets

10mm

10mm

10mm

10mm

10mm

PISTON MADE OF ALUMINUM CAST ALLOY AND METHOD OF MANUFACTURING THE SAME

CROSS-REFERENCES TO RELATED APPLICATIONS

The present application claims priority under 35 U.S.C. § 119 to Japanese Patent Application No. 2002-212773, filed Jul. 22, 2002, entitled "PISTON COMPOSED OF ALUMINUM CAST ALLOY AND MANUFACTURING METHOD OF THE SAME". The contents of this application are incorporated herein by reference in their entirety.

BACKGROUND OF THE INVENTION

1. Field of the Invention

The present invention relates to a piston made of aluminum cast alloy and a method of manufacturing the same.

2. Discussion of the Background

In an internal combustion engine such as an engine of automobile or the like, a piston is essential as a part constituting the internal combustion engine, conventionally, the piston has been manufactured by employing an aluminum cast alloy. For the aluminum cast alloy, a variety of alloys have been proposed and improved.

For example, in JP 1996-104937 Unexamined Patent Publication (Kokai), which has been entitled as "Aluminum alloy for an internal combustion engine excellent in strength at a high temperature and method of manufacturing the same", an alloy containing Cu (Copper): 3-7 mass %, Si (Silicon): 8-13 mass %, Mg (Magnesium): 0.3-1 mass %, Fe (Iron): 0.1-1.0 mass %, Ti (Titanium): 0.01-0.3 mass %, P (Phosphorus): 0.001-0.01 mass %, Ca (Calcium): 0.0001-0.01 mass %, and further containing Ni (Nickel): 0.2-2.5 mass % if it is necessary, and in which P (Phosphorus)/Ca (Calcium) is adjusted in the range from 0.5 to 50 in weight ratio has been published.

The alloy indicated in JP 1996-104937 is characterized in that the foregoing alloy maintains an excellent abrasive resistance comparing to the conventional alloys, and further, the strength at a high temperature has been improved. However, the thermo-mechanical fatigue property has not been considered at all, and there is a problem that the thermo-mechanical fatigue resistance of the above alloy is low. Furthermore, there is a problem that pores tend to be easily generated and the fatigue property is widely dispersed.

Moreover, in the above-described alloy, the strength at a high temperature is enhanced to some extent by increasing the components for enhancing the heat resistance such as Cu (Copper), Ni (Nickel) and the like, however, if the amount of addition of these is increased, there rises a problem that the ductility is lowered, thereby the fatigue strength and thermo-mechanical fatigue property is lowered. Moreover, if the amount of Cu (Copper) is high, the final solidification portion in which Cu (Copper) compound is crystallized dots within the material, pores are generated at that portion by solidification shrinkage.

In this way, practical fatigue properties such as thermo-mechanical fatigue property and so on, which are required for the piston top face section, cannot be enhanced at all only by the conventional methods in which heat resistance components are increased.

SUMMARY OF THE INVENTION

The present invention has been made considering such conventional problems, and an object of the present invention is to provide a piston made of aluminum cast alloy which is more excellent in thermo-mechanical fatigue resistance comparing to the conventional ones and a method of manufacturing the piston.

According to the first aspect of the present invention, a piston made of aluminum cast alloy is characterized in that the foregoing piston made of aluminum cast alloy includes: Mg (Magnesium): equal to or less than 0.2 mass %, Ti (Titanium): 0.05-0.3 mass %, Si (Silicon): 10-21 mass %, Cu (Copper): 2-3.5 mass %, Fe (Iron): 0.1-0.7 mass %, Ni (Nickel): 1-3 mass %, P (Phosphorus): 0.001-0.02 mass %, Al (Aluminum): the remaining portions, and impurities.

According to the first aspect of the present invention, it has been found for the first time that the stabilization and the high ductility of base aluminum matrix is contemplated by means of reducing the amount of Mg (Magnesium), to which is referred below, whereby the thermo-mechanical fatigue resistance characteristic required for a piston is enhanced.

The thermally unstable $Mg_2Si$ based precipitate which is dispersed into the base aluminum phase can be reduced by reducing the amount of Mg (Magnesium). This coarsens with the heating when the piston is actually used, and causes the change of the structure. Therefore, the thermal stability can be enhanced by reducing the above-described $Mg_2Si$ based precipitate.

Moreover, under the thermo-mechanical fatigue environment, the strain concentration is generated around the coarsened precipitate, whereby the ductility of the base aluminum phase is lowered and the thermo-mechanical fatigue resistance is lowered. Therefore, it considered that the reduction of the amount of Mg (Magnesium) which generates the precipitate suppresses the lowering of the ductility of the base aluminum phase under the thermo-mechanical fatigue environment, and the enhancement of thermo-mechanical fatigue resistance is provided. The enhancement of the thermo-mechanical fatigue resistance due to such reduction of the amount of Mg (Magnesium) (that is to say, the lessening of Mg) is entirely a new concept in which the conventional piston alloys have not been involved.

Then, the above-described piston can enhance the thermo-mechanical fatigue resistance as described above, and the durability of the whole of the piston can be enhanced comparing to the conventional ones.

It should be noted that as for the above-described piston, even if the piston is in an as cast state without performing the heat treatment after the casting has been carried out, as described later, the above-described excellent thermo-mechanical fatigue resistance is obtained. On the other hand, as described later, various performances have been carried out by adding various heat treatments after the casting.

Hereinafter, the reason why the respective amounts of alloy elements are limited will be described.

Mg (Magnesium): equal to or less than 0.2 mass %;

Mg (Magnesium) has been reduced for the purpose of realizing the stabilization of the structure and the enhancement of the ductility. When Mg content exceeds over 0.2%, the ductility of the base aluminum phase under the thermo-mechanical fatigue environment is lowered, the demerit that a cracking due to the thermo-mechanical fatigue is easily occurred is generated. The preferred range is in the range of being equal to or less than 0.1%, in this case, the above-described effect is more clearly expressed, and the more preferred range is in the range of being equal to or less than 0.05%. The optimum amount is zero (0). Although the less the content is, the larger the above-described merit, since it costs much, the above-described limitation is carried out. Therefore, for the Mg (Magnesium) content, it is preferable that it is in the range from 0-0.2 mass % (not including 0(zero)).

Ti (Titanium): 0.05-0.3 mass %;

In the case where Ti content is less than 0.05%, since solute Ti (Titanium) amount in the base aluminum is low, a sufficient solid solution strengthening is not obtained. In the case where Ti (Titanium) content is more than 0.3%, there is not only a fear that shearing rupture is occurred because the base aluminum phase becomes too hard due to solute Ti (Titanium), there is but also a fear that a coarse Ti (Titanium) compound is generated and the toughness is lowered.

It should be noted that in the case where the addition of Ti (Titanium) is carried out with Al—Ti-Balloy, Al—Ti—C alloy and the like, the containing of B (Boron) and C (Carbon) is allowed as an impurity. The preferred range of Ti (Titanium) content is in the range from 0.15-0.3%. When the range is equal to or more than 0.15%, since the structure is homogenized by making crystal grain fine, the fatigue strength is enhanced.

Cu (Copper): 2-3.5 mass %;

In the case where Cu (Copper) content is less than 2%, the yield strength at a high temperature nearby 350° C. is not sufficient, and the fatigue strength is also low. When the content exceeds over 3.5%, the final solidification portions in which Cu (Copper) compound is crystallized dot, pores are generated at these sites by solidification shrinkage, and the fatigue strength is lowered. The preferable range is in the range from 2.5-3.25%. In this range, the stabilized and higher fatigue property is obtained.

Si (Silicon): 10-21 mass %;

In the case where Si (Silicon) content is less than 10%, there is a fear that hyper-eutectic solidification cannot be realized even if P (phosphorus) is added, and hypo-eutectic solidification is occurred. In the case where it is hypo-eutectic solidified, since the base α-Al phase discharging a gas which is a cause of the pores is massively solidified, the final solidification portions dot, the pores tend to be easily generated. On the other hand, in the case where Si (Silicon) content exceeds over 21%, there is a fear that coarse primary Si (Silicon) crystal is generated in a large amount, the ductility at a low temperature, and the toughness is significantly lowered. Moreover, there is a fear that the machinability is significantly lowered.

The higher Si (Silicon) amount is, the more the fatigue strength at a high temperature nearby 350° C. is enhanced. The preferable range is in the range from 11-17%. Since in this range, hyper-eutectic solidification is steadily obtained, the size of the primary crystal and the amount are moderate as well, a higher fatigue property and a moderate machinability are obtained.

Fe (Iron): 0.1-0.7 mass %;

Due to Fe (Iron) content, Fe (Iron) compound is generated as a crystallized phase. The yield strength at a high temperature is enhanced by the dispersion strengthening of this crystallized phase. In the case where Fe (Iron) content is less than 0.1%, the amount of crystallized phase is slight, and the enhancement of the yield strength at a high temperature is not sufficient. In the case where the Fe (Iron) content exceeds over 0.7%, the coarse Fe (Iron) compound tends to be easily generated, and there is a fear that the fatigue property is lowered by stress concentration. It should be noted that the term Fe (Iron) compound is referred to a generic term for compounds including Fe (Iron).

Ni (Nickel): 1-3 mass %;

As similarly to Fe (Iron), Ni (Nickel) also crystallize the compound, and contributes to the enhancement of the yield strength at a high temperature due to the strengthening of dispersion. In the case where Ni (Nickel) content is less than 1%, the crystallization of Ni (Nickel) compound is slight, and the enhancement of the yield strength at a high temperature is not sufficient. There is a fear that a coarse Ni (Nickel) compound is crystallized and the fatigue property is lowered by the occurrence of the stress concentration in the case where Ni (Nickel) content exceeds over 3%.

P (Phosphorus): 0.001-0.02 mass %;

The stabilized hyper-eutectic solidification is achieved by adding P (Phosphorus), and the occurrence of the pores is prevented. Moreover, the primary Si (Silicon) crystal is made fine, and the ductility and the toughness are secured. In the case where P (Phosphorus) content exceeds over 0.02 mass %, the fluidity becomes worse, and casting failures such as misrun and the like tend to be easily generated.

According to the second aspect of the present invention, a method of manufacturing a piston made of aluminum cast alloy is characterized in that the method includes: a casting step of forming a piston by casting aluminum cast alloy which includes Mg (Magnesium): equal to or less than 0.2 mass %, and Ti (Titanium): 0.05-0.3 mass %, Si (Silicon): 10-21 mass %, Cu (Copper): 2-3.5 mass %, Fe (Iron): 0.1-0.7 mass %, Ni (Nickel): 1-3 mass %, P (Phosphorus): 0.001-0.02 mass %, Al (Aluminum): the remaining portions and impurities, and a cutting step of providing a cutting operation to the piston.

According to this method of manufacturing, the above-described piston having an excellent thermo-mechanical fatigue resistance described above can be easily manufactured. Now, after the above-described casting step has been carried out, it can be in an as cast state without particularly performing the heat treatment. Moreover, as described later, a variety of heat treatments can be added after the casting step has been carried out.

It should be noted that the reason why the respective alloy elements for the above-described aluminum cast alloy are limited is nearly the same with the above-described reasoning.

According to the third aspect of the present invention, a piston made of aluminum cast alloy is characterized in that the foregoing piston made of an aluminum cast alloy includes Mg (Magnesium): 0.2-2 mass %, Ti (Titanium): 0.05-0.3 mass %, Si (Silicon): 10-21 mass %, Cu (Copper): 2-3.5 mass %, Fe (Iron): 0.1-0.7 mass %, Ni (Nickel): 1-3 mass %, P (Phosphorus): 0.001-0.02 mass %, Al (Aluminum): the remaining portions, and impurities, and wherein pre-use Vickers hardness (Vickers hardness prior to the initiation of use) of the piston is in the range from HV 70 to 100.

An aluminum cast alloy constituting this piston is set Mg (Magnesium) content high comparing to the metal according to the above-described first aspect of the present invention, and it has been made Mg (Magnesium) content in the range from 0.2-2 mass %. Accompanying with this, in the step of manufacturing, for example, Vickers hardness prior to the initiation of use after incorporating it into an internal combustion engine as a piston has been adjusted in the range from HV 70 to 100 by providing the annealing.

Owing to this, as for the above-described piston, the thermo-mechanical fatigue resistance can be enhanced, and the durability of the whole of the piston can be enhanced comparing to the conventional ones.

As described above, Mg (Magnesium) content is increased up to the level of 0.2-2 mass %. Mg (Magnesium) causes to generate $Mg_2Si$ based precipitate, the yield strength at a low temperature of being equal to or less than 200° C. can be improved by its precipitation strengthening. When Mg (Magnesium) content is increased, $Mg_2Si$ is generated as a crystallized phase in the step of solidifying. When Mg (Magnesium) content exceeds over 2 mass %, since the amount of crystallized phase becomes too much, and it is coarsened, thereby toughness of the precipitated compound becomes lower. On the other hand, in the case where the Mg (Magnesium) is less than 0.2 mass %, the amount of alloy is slight, and the fatigue strength at the temperature of 200° C. as a material is not sufficient.

Moreover, as described above, the hardness of the piston has been made in the range from HV 70 to 100 in terms of Vickers hardness. Owing to this, even if Mg (Magnesium) content is much, an excellent thermo-mechanical fatigue resistance can be realized.

In the case where the above-described Vickers hardness exceeds over HV 100, the enhancement effect of thermo-mechanical fatigue resistance is not obtained much. Moreover, it is difficult that the hardness of the above-described aluminum cast alloy is made lower than HV 70 which is the lower limit within the range of the above-described composition. It should be noted that in the case where it is less than HV 80, there is a fear that the fatigue strength under the environment in which the temperature is equal to or less than the temperature of 200° C. is not sufficient. Moreover, in the case where it is equal to or less than HV 95, the effect of the enhancement of the thermo-mechanical fatigue resistance becomes clearer. Therefore, it is preferable that the hardness of the above-described piston is in the range of HV 80 to 95 in terms of Vickers hardness.

It should be noted that the term Vickers hardness described in the present specification indicates an average value of the whole of structure which has been found from a comparative large indentation so that the variation due to the structure does not emerge by making the value found under the conditions of load: 10 kg and press fitting time: 30 seconds be the reference.

According to the fourth aspect of the present invention, a method of manufacturing a piston made of aluminum cast alloy is characterized in that the method includes: a casting step of forming a piston by casting aluminum cast alloy which includes Mg (Magnesium): 0.2-2 mass %, Ti (Titanium): 0.05-0.3 mass %, Si (Silicon): 10-21 mass %, Cu (Copper): 2-3.5 mass %, Fe (Iron): 0.1-0.7 mass %, Ni (Nickel): 1-3 mass %, P (Phosphorus): 0.001-0.02 mass %, Al (Aluminum): the remaining portions and impurities, an annealing step of retaining the piston at a temperature of 250-400° C. for 0.5-24 hours in order to make that pre-use Vickers hardness of the piston in the range from HV 70 to 100, and a cutting step of providing a cutting operation to the piston prior to or after the annealing step.

According to the method of manufacturing, the above-described piston having the above-described excellent thermo-mechanical fatigue resistance can be easily manufactured.

It should be noted that the reason why the respective alloy elements of the above-described aluminum cast alloy are limited is similar to the above-described reason.

BRIEF DESCRIPTION OF THE DRAWINGS

A more complete appreciation of the invention and many of the attendant advantages thereof will become readily apparent with reference to the following detailed description, particularly when considered in conjunction with the companying drawings, in which.

DESCRIPTION OF THE PREFERRED EMBODIMENTS

Figure 1:
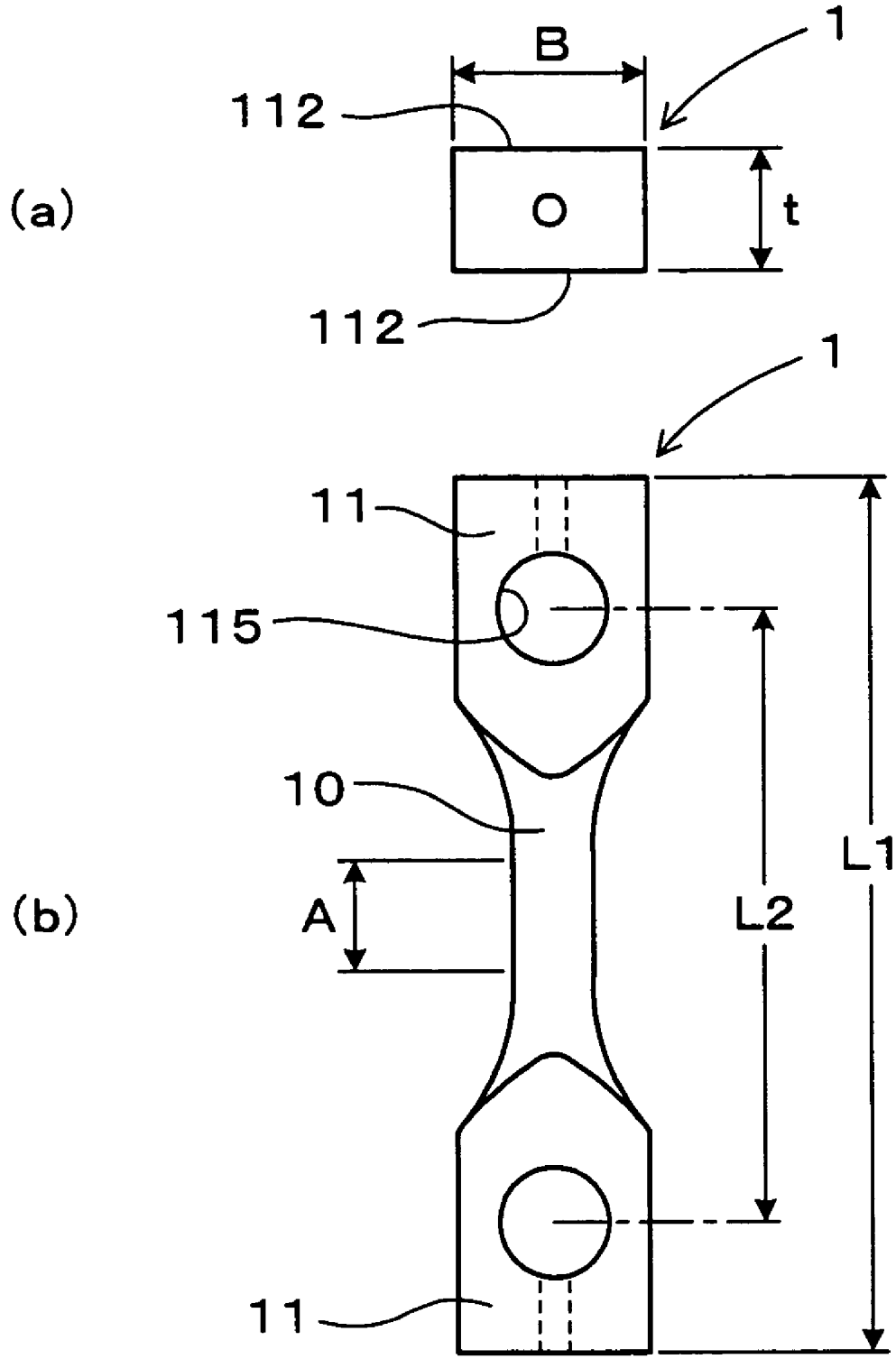
FIG. 1(*a*) is a plan view showing the shape and size of thermo-mechanical fatigue test piece in Example 1 of the present invention, and FIG. 1(*b*) is an elevational view showing the shape and size of thermo-mechanical fatigue test piece in Example 1 of the present invention.

In the above-described first and second aspects of the present invention, it is preferable that the above-described aluminum cast alloy further contains at least one of V (Vanadium) 0.02-0.3 mass %, and Zr (Zirconium): 0.02-0.3 mass %.

The yield strength at a high temperature is increased, and the fatigue strength at a high temperature is further enhanced by addition of V (Vanadium). Moreover, the additional effect that the fatigue strength at a high temperature is enhanced can be expressed without damaging the thermo-mechanical fatigue resistance by addition of V (Vanadium). In the case where V (Vanadium) content is less than 0.02%, the enhancement of the yield strength at a high temperature is not sufficient. In the case where V (Vanadium) content exceeds over 0.3%, the uniform dissolution is difficult, and there is a fear that the V (Vanadium) compound which has not been dissolved becomes an inclusion and the fatigue strength is lowered.

The yield strength at a high temperature is increased, and the fatigue strength at a high temperature is further enhanced by addition of Zr (Zirconium). Moreover, the additional effect that the fatigue strength at a high temperature is enhanced can be expressed without damaging the thermo-mechanical fatigue resistance by addition of Zr (Zirconium). Furthermore, the crystal grain is made fine by addition of Zr (Zirconium), and the stabilized fatigue property is steadily obtained. In the case where Zr (Zirconium) content is less than 0.02%, the enhancement of the yield strength at a high temperature is not sufficient. In the case where Zr (Zirconium) content exceeds over 0.3%, the uniform dissolution is difficult, and there is a fear that the Zr (Zirconium) compound which has not been dissolved becomes an inclusion and the fatigue strength is lowered.

Moreover, in a piston of the above-described first and second aspects of the present invention, it is preferable that the above-described aluminum cast alloy further contains Mn (Manganese): 0.2-0.7 mass %.

Similarly to Fe (Iron), Mn (Manganese) also makes the compound crystallized, and contributes to the enhancement of the yield strength at a high temperature due to the dispersion strengthening. Moreover, since there is also an effect that the solid solution is carried out in the base aluminum, the yield strength at a high temperature is enhanced by solid solution strengthening, and it is preferable that Mn (Manganese) is contained equal to or more than 0.2 mass %. In the case where Mn (Manganese) content exceeds over 0.7%, a coarse Mn (Manganese) compound tends to be easily generated, there is a fear that the fatigue property is lowered due to the occurrence of the stress concentration. It should be noted that the term Mn (Manganese) compound is referred to a generic term of compounds including Mn (Manganese). Mn (Manganese) is also contained in Fe (Iron) compound. For example, since Al—Si—Fe—Mn compound contains Fe (Iron) and Mn (Manganese), it belongs to both Fe (Iron) compound and Mn (Manganese) compound. It is also preferable that Fe (Iron) of 0.2 mass % or more is contained for improved yield strength at a high temperature.

Moreover, as for a piston of the above-described first aspect of the present invention, it is preferable that pre-use Vickers hardness of the piston is in the range from HV 70 to 100. Owing to this, the thermo-mechanical fatigue resistance can be further enhanced. In the case where the above-described Vickers hardness exceeds over HV 100, not so much effect of the enhancement of thermo-mechanical fatigue resistance is obtained. Moreover, in the case where the hardness of the above-described aluminum cast alloy is within the range of the above-described composition, it is difficult to make its hardness lower than HV 70 which is the lower limit value. It should be noted that in the case where it is lower than HV 80, there is a fear that the fatigue strength under the environment lower then the temperature of 200° C. is not sufficient. Moreover, in the case where the hardness is equal to or lower than HV 95, the effect of the enhancement of the thermo-mechanical fatigue resistance becomes obvious. Therefore, it is more preferable that the hardness of the above-described piston is in the range from HV 80 to 95 in terms of Vickers hardness. The reason why the lower hardness can obtain a better improvement in the thermo-mechanical fatigue resistance, as described above, is due to the effect that the stabilization of the structure is enhanced as described above.

Moreover, in the above-described first aspect of the present invention, it is preferable that the size of non-metal inclusion existed within the above-described piston is less than 100 μm. In the case where the size of the above-described inclusion is equal to or more than 100 μm, there is a problem that the fatigue strength and the thermo-mechanical fatigue lifetime are significantly lowered. Moreover, as the size of the above-described inclusion, it is preferable that it is equal to or less than 50 μm. Herein, the size of the above-described inclusion is referred to as a representative size of the largest area out of the above-described inclusions observed at the time when the metal structure of the piston has been observed. As a representative method of finding the size, there is a method of taking the square root of the area and the like.

It should be noted that as the above-described inclusions, for example, there are oxides, sulfides, nitrides, carbides, silicates and the like whose main component is Al (Aluminum).

Next, in the above-described second aspect of the present invention, it is preferable that after the above-described piston has been formed by the above-described step of casting, the above-described piston is stood to cool to room temperature. Specifically, it is preferable that after the above-described piston has been cast, the above-described piston is used in an as cast state where the above-described piston is stood to cool without performing the heat treatment. In this case, not only the step of manufacturing can be rationalized, but also the stability of the structure is enhanced since the precipitated compound which is stable at a high temperature is generated while being stood to cool after casting, and further, a new advantage that the thermo-mechanical fatigue property becomes excellent. Furthermore, there is an effect that the piston becomes excellent in heat resistance and the fatigue strength at a high temperature becomes high.

Moreover, in the above-described second aspect of the present invention, it is also preferable that after the above-described piston has been formed by the above-described step of casting, prior to or after the above-described cutting step, an annealing step of retaining the piston at a temperature of 250-400° C. for 0.5-24 hours is carried out so that pre-use Vickers hardness of the relevant piston is in the range from HV 70 to 100.

The above-described step of annealing may be carried out in any step up to the step in which the above-described piston is mounted on an engine and used, or, as described above, the annealing may be carried out either prior to or after the cutting step. However, it is preferable that the above-described annealing step is carried out prior to the above-described cutting step. Owing to this, even in the case where the deformation is generated due to the thermal influence at the time when annealing, the accuracy of sizing can be enhanced in the subsequent cutting step.

In the case where the temperature of the above-described annealing is less than 250° C. and the retention time is less than 0.5 hours, the hardness of the piston cannot be sufficiently softened, and therefore it is difficult that the Vickers hardness is made equal to or less than HV 100. On the other hand, in the case where the annealing temperature exceeds over 400° C., there is a problem that by solid solution of Cu (Copper) and Mg (Magnesium) occurring again, the precipitation hardening is generated at the time when cooling is performed after the annealing and during the subsequent room temperature retention, and the hardness becomes high. Moreover, in the case where the retention time exceeds over 24 hours, there is a problem that the heat treatment cost becomes higher.

It should be noted that the cooling after the above-described annealing may be carried out by either being stood to cool or water cooling.

Moreover, in the above-described second aspect of the present invention, it is preferable that after the casting step has been carried out, a solution heat treatment step of retaining the piston at the temperature of 450° C.-510° C. for 1-12 hours has been carried out, then, the quenching step of rapidly cooling the above-described piston is provided, and subsequently, the above-described annealing step is carried out.

In this case, since the corner section of the crystallized phase are rounded, the stress concentration are reduced and also a stable precipitated compound is generated at a high temperature, an effect that the coarsening of the precipitated compound at the time when it is used, and the lowering of the toughness can be suppressed is obtained.

It should be noted that the above-described step of quenching is a heat treatment step, rapid cooling from a high temperature is carried out in which in order to obtain the supersaturated solid solution, and can be performed by, for example, the quenching in warm water or in cooled water.

Moreover, in the case where the above-described solution heat treatment temperature is less than 450° C., there is a problem that the corner portions of the crystallized phase is not sufficiently rounded and the solid solution of the precipitated compound forming elements are not sufficient. On the other hand, in the case where the solution heat treatment temperature exceeds over 510° C., there is a fear that the compound containing Cu (Copper) is partially melted and when it is solidified again, the defects such as pores and the like are generated.

Moreover, in the case where the retention time at the above-described sold solution heat treatment temperature is less than one hour, there is a problem similar to the case where the above-described solution heat treatment temperature is less than 450° C., whereas in the case where the treatment time exceeds over 12 hours, the heat treatment cost becomes high and the production efficiency gets worse as well.

Moreover, in the above-described second aspect of the present invention, it is preferable that after the above-described quenching step has been carried out, an aging step of retaining the above-described piston at a temperature of 180-280° C. for 1-12 hours is provided, and subsequently, the annealing step is carried out. In this case, the precipitated compound is more uniformly dispersed, and a stable excellent thermo-mechanical fatigue resistance is obtained.

On the other hand, in the case where the above-described aging temperature is less than 180° C., there is a problem that the amount of precipitation is not sufficient at the time of aging, whereas in the case where the above-described aging temperature exceeds over 280° C., there is a problem that since the precipitation is not uniformly generated at the time of aging, the distribution of the precipitated compound which has been coarsened by the annealing is also heterogeneous.

Moreover, in the case where the retention time at the above-described aging temperature is less than 1 hour, there is a problem that the aging precipitated amount is not sufficient, whereas in the case where the retention time at the above-described aging temperature exceeds over 12 hours, even if the heating is further performed, there is a problem that the effect is not largely changed, and the cost becomes higher.

It should be noted that the term the step of aging described in the present specification is referred to as a heat treatment step which raises the hardness, whereas the term the step of annealing is referred to as a heat treatment step which lowers the hardness.

It should be noted that as a casting method of the above-described piston, a gravity casting could be utilized at a low cost. However, it can be also manufactured by a high pressure casting, die casting or the like.

Next, also in the above-described third and fourth aspects of the present invention, for the reasons similar to the above-described cases, it is preferable that the above-described aluminum cast alloy further contains at least one of V (Vanadium) 0.02-0.3 mass %, and Zr (Zirconium): 0.02-0.3 mass %.

Moreover, also in the above-described third and fourth aspects of the present invention, for the reason similar to the above-described cases, it is preferable that Mn (Manganese): 0.2-0.7 mass % is contained. Moreover, it is preferable that Fe (Iron) content is equal to or more than 0.2 mass %.

Moreover, also in the above-described third aspect of the present invention, for the reasons similar to the cases described above, it is preferable that the size of non-metal inclusion existing within the above-described piston is less than 100 μm.

Moreover, in the above-described fourth aspect of the present invention, as described above, after the above-described piston has been formed by the above-described step of casting, the step of annealing for retaining the temperature of 250-400° C. for 0.5-24 hours is carried out prior to or after the above-described step of cutting so that pre-use Vickers hardness of the relevant piston is in the range from HV 70 to 100.

The above-described step of annealing in this case may be also carried out in any step up to the step in which the above-described piston is mounted on an engine, as described above, it may be carried out prior to or following the cutting step. However, it is preferable that the above-described step of annealing is carried out prior to the above-described step of cutting in order to enhance the accuracy of sizing.

In the case where the above-described annealing temperature is less than 250° C. and the retention time is less than 0.5 hours, the hardness of the piston cannot be sufficiently softened, and it is difficult that Vickers hardness is made equal to or less than HV 100. On the other hand, in the case where the annealing temperature exceeds over 400° C., there is a problem that by solid solution of Cu (Copper) and Mg (Magnesium) occurring again, the precipitation hardening is generated at the time when cooling is performed after the annealing and during the subsequent room temperature retention, and the hardness becomes high. Moreover, in the case where the retention time exceeds over 24 hours, there is a problem that the heat treatment cost become higher.

It should be noted that the cooling after the above-described annealing may be carried out by either being stood to cool or water cooling.

Moreover, also in the above-described fourth aspect of the present invention, it is preferable that after the above-described casting step is carried out, the solution heat treatment step of retaining the above-described piston at a temperature of 450-510° C. for 1-12 hours is carried out, then, the quenching step of rapidly cooling the above-described piston is provided, and subsequently, the above-described annealing step is carried out.

In this case, since the corner portions of the crystallized phase are rounded, the stress concentration is reduced and also a stable precipitated compound is generated at a high temperature, an effect that the coarsening of the precipitated compound at the time when it is used, and the lowering of the toughness accompanying that can be suppressed is obtained.

It should be noted that the above-described step of quenching could be carried out by performing the quenching in warm water or in cooled water.

Moreover, in the case where the above-described solution heat treatment temperature is less than 450° C., there is a problem that the corner portions of the crystallized phase are not sufficiently rounded and the solid solution of the precipitated compound forming elements are not sufficient. On the other hand, in the case where the solution heat treatment temperature exceeds over 510° C., there is a fear that the compound containing Cu (Copper) is partially melted and solidified again, the defects such as pores and the like are generated.

Moreover, in the case where the retention time at the above-described solution heat treatment temperature is less than 1 hour, there is a problem similar to the case where the above-described solution heat treatment temperature is less than 450° C., whereas in the case where the treatment time exceeds over 12 hours, the heat treatment cost becomes high and the production efficiency becomes lower as well.

Moreover, in the above-described fourth aspect of the present invention, it is preferable that after the above-described quenching step is carried out, the aging step of retaining the above-described piston at a temperature of 180-280° C. for 1-12 hours is provided, and subsequently, the annealing step is carried out. In this case, the precipitated compound is more uniformly dispersed, and a stable and excellent thermo-mechanical fatigue resistance is obtained.

On the other hand, in the case where the above-described aging temperature is less than 180° C., there is a problem that the amount of precipitation is not sufficient at the time when aging is carried out, whereas in the case where the above-described aging temperature exceeds over 280° C., there is a problem that since the precipitation at the time when aging is carried out is not uniformly generated, the distribution of the precipitated compound which has been coarsened by the annealing is also heterogeneous.

Moreover, in the case where the retention time at the above-described aging temperature is less than 1 hour, there is a problem that the aging precipitation amount is not sufficient, whereas in the case where the retention time at the above-described aging temperature exceeds over 12 hours, even if the heating is further performed, there is a problem that the effect is not largely changed and the cost becomes higher.

It should be noted that as a casting method of the above-described piston in the forth aspect if the present invention, a gravity casting at a low cost could be utilized. However, it can also be manufactured by a high pressure casting, die casting or the like.

In the above-described first-fourth aspects of the present invention, it is preferable that the followings are further carried out with respect to the composition of components of the above-described casting alloy.

<Addition of Ca (Calcium): 0.0005-0.003 Mass %>

For example, in the case where the crystal grain refining elements such as Ti (Titanium), Zr (Zirconium), V (Vanadium) and the like are contained, if a trace of Ca (Calcium) is added, the crystal grain is more refined, and the effect that the structure is homogenized is obtained. In the case where the crystal grain refining elements such as Ti (Titanium) and the like are not contained, or in the case where if these are contained but the content does not satisfy the above-described range of the present invention, even if Ca (Calcium) is added, the effect of refining the crystal grain is not obtained. Moreover, even in the case where it is in the component range of the present invention, if Ca (Calcium) content is less than 0.0005 mass %, the effect of refining the crystal grain is not obtained. In addition, in the case where it exceeds over 0.003 mass %, the dendrite structure becomes conspicuous, and the structure becomes heterogeneous. Moreover, since if Ca (Calcium) content is too much, the pores may tend to be easily generated, it is more preferable that the upper limit of Ca (Calcium) content is made equal to or less than 0.002 mass %.

<Addition of Cr (Chromium): 0.01-0.5 Mass %>

The effect that the crystal grain is more refined is obtained by adding a trace of Cr (Chromium). As similar to the case where the above-described Ca (Calcium) is added, this effect is expressed only in the alloy of the present invention sufficiently containing the crystal grain refining elements such as Ti (Titanium) and the like. In the case where Cr (Chromium) content is less than 0.01 mass %, the effect of refining the crystal grain is small, and in the case where Cr (Chromium) content exceeds over 0.5 mass %, a coarse compound containing Cr (Chromium) is generated, and the ductility of the alloy is lowered.

<Regulation of B (Boron): Less than 0.01 Mass %>

If B (Boron) content is increased, the heat resistance is lowered. Therefore, it is preferable that B (Boron) content is regulated to be less than 0.01 mass %.

<Addition of Be (Beryllium): 0.01-0.5 Mass %>

Be (Beryllium) has an effect of making the form of Fe (iron) compound better and improving the castability. In the case where Be (Beryllium) content is less than 0.01 mass %, the castability-improving effect is not sufficiently obtained, and in the case where Be (Beryllium) content exceeds over 0.5 mass %, the enhancement of the effects due to the addition of Be (Beryllium) is not obtained, and it is a waste of cost.

<Optimum Contents of Ti (Titanium), Zr (Zirconium) and V (Vanadium)>

In the case where all of Ti (Titanium), Zr (Zirconium) and V (Vanadium) are contained, it is preferable that the respective contents are made Ti (Titanium): 0.15-0.3 mass %, Zr (Zirconium): 0.05-0.12 mass %, and V (Vanadium): 0.03-0.12 mass %. Owing to this, the crystal grain is sufficiently refined, and the optimum homogenized structure is obtained. In the case where both Zr (Zirconium) content and V (Vanadium) content exceed over 0.12 mass %, a compound with Ti (Titanium) tends to be easily generated at the time of melting, and there is a fear that the refining of the crystal grain is not sufficient and the micro-structure becomes heterogeneous by the dendrites being aligned.

<Preferred Content of P (Phosphorus)>

In the case where P (Phosphorus) content is slight, a hypo-eutectic structure with dendrites is obtained, and there is a fear that the micro-structure becomes heterogeneous. Therefore, it is preferable that P (Phosphorus) content is made equal to or more than 0.005 mass %.

EXAMPLES

Example 1

In the present Example, as an aluminum cast alloy used for a piston, as indicated in Tables 1-4, for Example of the present invention, 21 species of aluminum cast alloys "Mg-less alloys" (Mg (Magnesium) content: less than 0.2 mass %) (Table 1) and 5 species of aluminum cast alloys "Mg-contained alloys" (Mg (Magnesium) content: equal to or more than 0.2 mass %) (Table 2) have been prepared. Furthermore, as Comparative Example, 6 species of aluminum cast alloys that contain Mg (Magnesium) content (Table 3) and 3 species of aluminum cast alloys that contain a trace of Mg (Magnesium) content (Table 4) have been prepared. Then, test pieces have been prepared by applying a variety of methods of manufacturing to Examples and Comparative Examples, respectively, and their thermo-mechanical fatigue tests have been performed.

First, the respective aluminum alloys having a chemical composition as indicated in Tables 1-4 were melted. The molten metal temperature is set at 740-760° C., after deoxidizing treatment has been provided by adding a fluxing agent, vacuum degassing treatment for retaining for 20 minutes under the vacuum has been provided. Subsequently, the above-described molten metals were poured into the boat mould for collecting JIS No. 4 test pieces at room temperature on which BN (Boron nitride) has been coated on its surface. The pouring temperature is 700° C.+/−20° C. It should be noted that the boat which was cooled to room temperature was used after the boat has been previously heated by a burner and water content has been removed.

Next, as indicated in Tables 5-8, the following heat treatments were carried out for the obtained casting materials as necessary.

<T6 Treatment>

After heating at 495° C. for 3 hours, the solution treatment that performs the quenching of the materials into warm water at 50° C. was provided, and subsequently, the aging treatment was carried out at 210° C. for 3 hours.

<T5 Treatment>

After the materials have been cast into metal molds and stood to cool to the level of room temperature, the aging treatment was carried out at 220° C. for 6 hours.

<F Treatment>

After the materials have been cast into metal molds, only stood to cool to the level of room temperature.

<Water Cooling T5 Treatment>

Immediately after the materials have been cast into metal molds, the materials were quenched into warm water at 50° C. from a high temperature equal to or more than 400° C., and then, the aging treatment at 220° C. for 6 hours was carried out.

<T6+S Treatment>

After the above-described T6 treatment has been carried out, the annealing treatment was carried out at 350° C. for 2 hours.

<T5+S Treatment>

After the above-described T5 treatment has been carried out, the annealing treatment was carried out at 350° C. for 2 hours.

<T6+S4 Treatment>

After the above-described T6 treatment has been carried out, the annealing treatment was carried out at 400° C. for 2 hours.

<TS Treatment>

After the heating has been carried out at 495° C. for 3 hours, the solution heat treatment in which the quenching has been carried out in warm water at 50° C. was provided, and subsequently, the annealing treatment was carried out at 350° C. for 2 hours.

Next, the thermo-mechanical fatigue test pieces and hardness measurement sample members were collected, by machine work from the casting materials to which the above-described heat treatment has been provided.

The parallel portion of the thermo-mechanical fatigue test piece was made ϕ4 mm in diameter and 6 mm in length, and the machining operation was carried out by setting the position at 14 mm height from the bottom of the boat as the axis center.

The thermo-mechanical fatigue test was carried out by a method in which test pieces of aluminum alloy is attached to the constraint holder made of low thermal expansion alloy and heating and cooling are repeated (e.g., the thermo-mechanical fatigue test methods indicated in (1) JP 1995-20031 Unexamined Patent Publication (Kokai), (2) JP2003-035644 Unexamined Patent Publication (Kokai), and (3) "Proceedings of CAMP2002 on High-temperature Fatigue", Eds.: G. Biallasetal., pp. 171-178).

Figure 2:
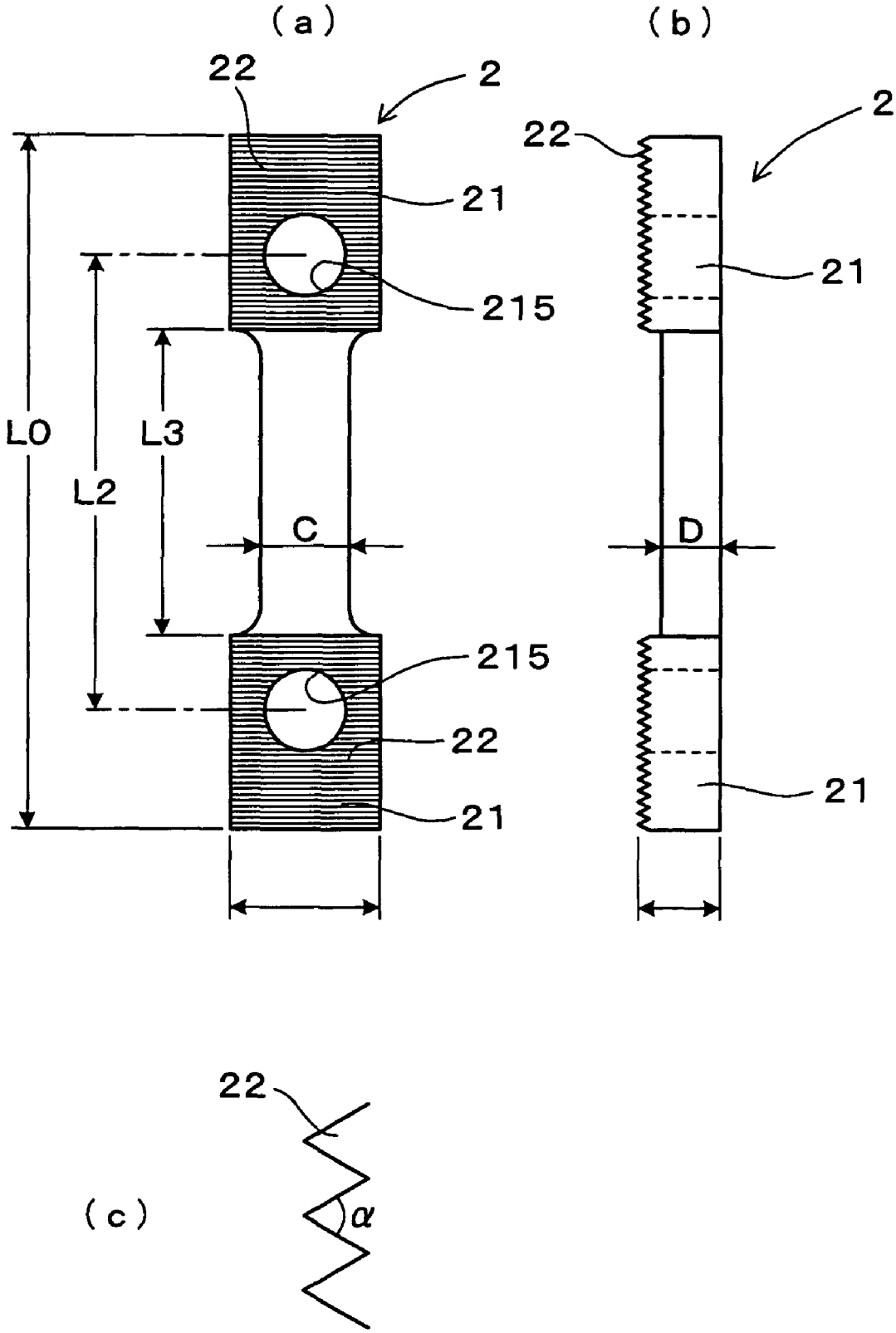
FIG. 2(*a*) is an elevational view showing the shape and size of a holder in Example 1 of the present invention, FIG. 2(*b*) is a side elevation view showing the shape and size of a holder in Example 1 of the present invention, and FIG. 2(*c*) is an enlarged illustration of the portion of a blade of a holder in Example 1 of the present invention.
Figure 3:
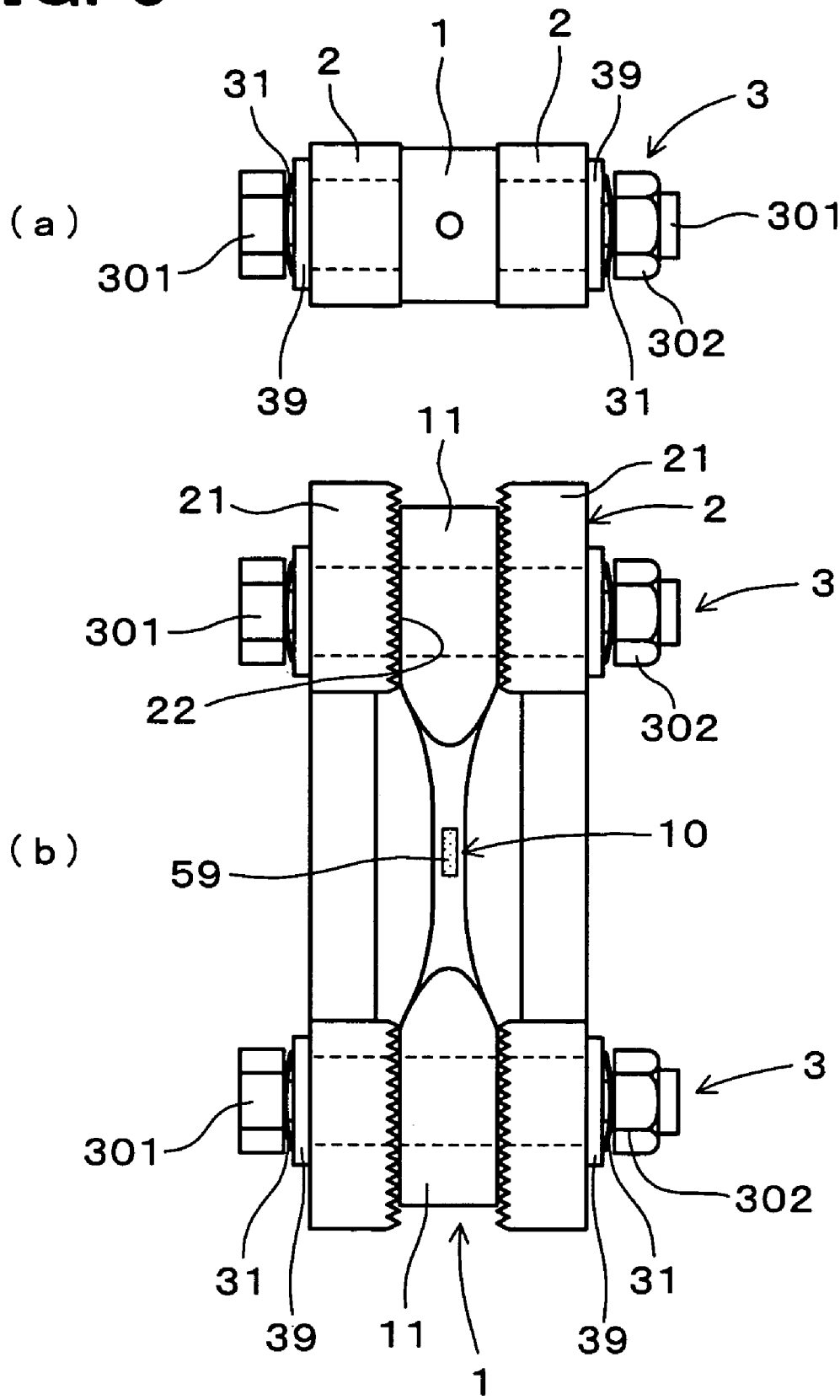
FIG. 3(*a*) is a plan view showing a constraint state of the thermo-mechanical fatigue test piece and the holder in Example 1 of the present invention, and FIG. 3(*b*) is an elevational view showing a constraint state of the thermo-mechanical fatigue test piece and the holder in Example 1 of the present invention.

Concretely, as shown in FIGS. 1-3, a thermo-mechanical fatigue test piece 1 in a rod shape having a portion to be evaluated (parallel portion) 10 at the center portion whose area is smaller than those of both end portions is prepared. Moreover, two piece of holders 2 onto which a plurality of V-shaped blades 22 have been provided at fixed end portions 21 existing on both sides for being in contact with both end portions 11 of the above-described thermo-mechanical fatigue test piece 1. The holders are composed of a low expansion material whose thermal expansion coefficient is smaller than that of the above-described thermo-mechanical fatigue test piece 1 and in which the temperature specific point changing its thermal expansion coefficient rapidly does not exist in the test temperature range.

Then, as shown in FIG. 3, when the above-described thermo-mechanical fatigue test piece 1 is constraint so that the above-described thermo-mechanical fatigue test piece 1 is sandwiched and held with the above-described holders 2 from both sides, the above-described blades 22 of the above-described holder 2 are pressed and inserted into the both end portions 11 of the above-described thermo-mechanical fatigue test piece 1. Accompanying this, in order to prevent the release of the coupling between the both end portions 11 of the above-described thermo-mechanical fatigue test piece 1 and the above-described fixed end portions 21 of the above-described holders 2, the both end portions 11 of the above-described thermo-mechanical fatigue test piece 1 and the above-described fixed end portions 21 of the above-described holders 2 are made constraint by coupling means 3 via an elastic member 31.

Moreover, a strain gauge 59 for measuring the mechanical strain generated with temperature change is disposed at the above-described portion to be evaluated 10 of the above-described thermo-mechanical fatigue test piece 1 if necessary (only at the time when strain measurement is carried out).

Then, the heating/cooling cycle is provided to the whole of the above-described thermo-mechanical fatigue test piece 1 and the above-described holders 2 as this constraint condition remains as it is, and the retightening of the above-described coupling means for suppressing the lowering of the coupling force between the both end portions 11 of the above-described thermo-mechanical fatigue test piece 1 and the fixed end portions 21 of the above-described holders 2 is carried out if necessary.

Then, the mechanical strain generated by the thermal expansion difference between the above-described thermo-mechanical fatigue test piece 1 and the above-described holder 2 is made locally concentrated into the above-described portion to be evaluated 10 of the above-described thermo-mechanical fatigue test piece 1, whereby the thermo-mechanical fatigue lifetime is found from the number of cycles of the above-described heating/cooling cycle at the time when the above-described thermo-mechanical fatigue test piece 1 was broken. Moreover, the total strain range is found by means of the above-described strain gauge.

In the present Example, the test temperature range has been set in the range from 50 to 350° C., and the repetition rate has been set at 4 min/cycle.

The material of the holder was Incoloy 903, and dimensions of the test piece and holder to be used are, as shown in FIGS. 1 and 2, L0=48 mm, L1=46 mm, L2=32 mm, L3=22 mm, and t=6 mm.

First, the validity of the thermo-mechanical fatigue test was checked and the total strain range of the initial period of the test was actually measured by a high temperature strain gauge by carrying out the thermo-mechanical fatigue test using a test piece made of JIS-AC8A alloy in order to make the test conditions clear as well. As a result of this, the total strain range at the initial period of the test was about 0.65%. Moreover, it has been confirmed that the center parallel portion of the test piece was broken, and the evaluation of the thermo-mechanical fatigue property was capable of being checked.

It should be noted that in the thermo-mechanical fatigue test using the test pieces of the above-described respective alloys, in order to prevent bolts and nuts for fastening the holders and the test piece from being released, the retightening of the bolts and nuts was carried out at 100, 500 and 1000 cycles and thereafter every 1000 cycle.

The thermo-mechanical fatigue lifetime (Nf) was determined from the results of the observation of cracks by visual inspection and the change of the temperature difference between the upper and lower portions of the test piece (because the temperature distribution is changed if it is broken). It should be noted that in the present test, it is considered that the macro-cracking occurrence lifetime and the breaking lifetime are approximately the same with each other and the macro-cracking occurrence lifetime is displayed by unifying it with the thermo-mechanical fatigue lifetime since if a macro-cracking which can be visually inspected is generated, the cracking rapidly propagates and reaches to the breaking.

The results of the performance evaluation of the alloys of Examples and Comparative Examples are shown in Tables 5-8. In these Tables, the existence and non-existence of Mg (Magnesium) is indicated as in the case where Mg (Magnesium) content is less than 0.2 mass % (actually, in the case where it is less than 0.01 mass %), being classified "no Mg (Mg-less)". Moreover, the characters HV denote Vickers hardness. Moreover, the characters Nf denote the number of cycles of the above-described heating/cooling cycle at the time when the test piece was broken.

Now, the characteristics of the sample member alloys are newly indicated, as follows:

In Comparative Examples 1-6, Mg (Magnesium) content alloys have been employed, concerning with the heat treatment, in Comparative Examples 1, 2, T6 treatment has been carried out, In Comparative Examples 3-5, T5 treatment has been carried out, and in Comparative Example 6, water cooling T5 treatment has been carried out.

In Comparative Examples 7-9, material that contains less Mg (Magnesium) or substantially none of it has been employed, and concerning the heat treatment, in Comparative Examples 7, 8, the F treatment has been carried out, and in Comparative Example 9, T5+S treatment has been carried out.

In Examples 1-19 and in Examples 23, 24, an alloy containing a trace amount of Mg (Magnesium) has been employed, and concerning the heat treatment, in Examples 1-3, T6 treatment has been carried out, in Examples 4-11, T6+S treatment has been carried out, in Example 12, TS treatment has been carried out, in Example 13, T6+S4 treatment has been carried out, in Examples 14, 15, T5 treatment has been carried out, in Example 16, water cooling T5 treatment has been carried out, in Examples 17, 18, F treatment has been carried out, in Example 19, water cooling T5+S treatment has been carried out, and in Examples 23, 24, T6 treatment has been carried out. It should be noted that in Examples 23, 24, Mn (Manganese) content has been made substantially 0 (zero) (less than 0.01 mass %).

Moreover, in Examples 20-22, and in Examples 25, 26, an alloy containing Mg (Magnesium) content has been employed, and concerning the heat treatment, in Examples 20, 21, T6+S treatment has been carried out, in Example 22, water cooling T5+S treatment has been carried out, and in Examples 25, 26, T6+S treatment has been carried out. It should be noted that in Examples 25, 26, Mn (Manganese) content has been made substantially 0 (zero) (less than 0.01 mass %).

As being clear from Table 5, it is understood that Mg-less alloy in which Mg (Magnesium) content is less than 0.01 mass % has a longer thermo-mechanical fatigue lifetime than the alloys of Comparative Examples.

As being clear from Table 7, it is understood from the fact that Mg (Magnesium) content of the alloys in Comparative Examples 1-6 are equal to or more than 0.25 mass %, that Mg (Magnesium) content of the alloys in Comparative Examples 1-6 is made at least less than 0.2 mass % is effective in order to obtain an excellent thermo-mechanical fatigue lifetime.

As indicated in Table 5, among the Mg-less alloys, the alloys in Examples 4-13 to which the annealing has been provided have especially long thermo-mechanical fatigue lifetimes.

In Example 12, the alloy in which the annealing has been provided while omitting the aging treatment of T6, however, it indicates a similar excellent thermo-mechanical fatigue lifetime.

In Examples 14-19, concerning the heat treatment, T5 treatment, water cooling T5 treatment, F treatment or water cooling T5+S treatment has been carried out, however, the thermo-mechanical fatigue lifetimes are longer than those of Comparative Examples in any heat treatment. Especially, in Examples 17, 18 in which F treatment has been carried out, excellent thermo-mechanical fatigue lifetimes are indicated.

Moreover, the Mg-less alloys of Examples 23, 24 in which Mn (Manganese) content is substantially 0 (zero) also indicates excellent characteristics similar to the alloys to which similar thermal treatment have been carried out.

As indicated in Table 6, in Examples 20-22, the annealed members made of alloys containing Mg (Magnesium) content, needless to say, indicate excellent thermo-mechanical fatigue lifetimes comparing to Comparative Examples 1-6. From these results, it is understood that if the base aluminum phase has been softened to some extent by annealing, an excellent thermo-mechanical fatigue lifetime is obtained even if it is a member containing Mg (Magnesium). The degree of softening of the base aluminum phase due to the annealing can be approximately evaluated by the hardness.

Moreover, the Mg-contained alloys of Examples 25, 26 in which Mn (Manganese) content is substantially 0 (zero)) also indicate excellent characteristics similar to the alloys to which similar thermal treatments have been carried out.

Moreover, from the results of Tables 4-7, in the sample members that have been adjusted equal to or less than HV 100 in terms of Vickers hardness by annealing, the enhancement of the thermo-mechanical fatigue lifetimes is clearly observed. Especially, in the sample member indicating Vickers hardness of being equal to or less than HV 95, the effect is significant.

Moreover, from the fact that the hardness of the sample members to which T5 treatment and T6 treatment have been carried out without performing the annealing (Comparative Examples 1-6) are equal to or more than HV101, it is determined that the effect of enhancement of the thermo-mechanical fatigue lifetime is obtained if the annealing conditions are set so that the hardness is in the range from HV 70 to 100 in terms of Vickers hardness.

From the aforementioned results, it is understood that the sample members using Mg-less alloys which Mg is reduced and which is annealed or cooled after casting in Examples 1-19 belonging to the first aspect of the present invention, and the sample members using the aluminum cast alloys which contains Mg (Magnesium) content belonging to the third aspect of the present invention but in which Vickers hardness has been adjusted in the range from HV 70 to 100 are excellent in thermo-mechanical fatigue property which is required for a piston.

Moreover, in Tables 4-8, the sizes of non-metal inclusions that are observed at the initiating point of the fracture of the respective test pieces are indicated. These inclusions are oxides whose major component is Al (Aluminum), for example, alumina or the like. The sizes of the above-described inclusions were found by taking the square root of the area.

As known from Tables 4-8, in the case where the size of non-metal inclusion is equal to or more than 100 μm, it is understood that the thermo-mechanical fatigue lifetime is short, and an excellent thermo-mechanical fatigue resistance that is inherent to an alloy cannot be sufficiently exerted. It should be noted that it is appropriate that the inclusion which is to be a initiating point is considered to be the maximum size among the inclusions existing within the test pieces.

TABLE 1

| | test material | chemical composition (mass %) | | | | | | | | | | |
|---|---|---|---|---|---|---|---|---|---|---|---|---|
| section | No. | Si | Cu | Mg | Ni | Fe | Mn | Ti | Zr | V | P | Al |
| example | 1 | 13.6 | 2.9 | <0.01 | 2.1 | 0.40 | 0.40 | 0.22 | <0.01 | <0.01 | 0.004 | remaining portion |
| | 2 | 13.9 | 2.9 | <0.01 | 2.1 | 0.36 | 0.38 | 0.19 | <0.01 | 0.05 | 0.004 | remaining portion |
| | 3 | 13.8 | 3.0 | <0.01 | 2.4 | 0.40 | 0.39 | 0.19 | 0.10 | 0.06 | 0.004 | remaining portion |
| | 4 | 13.8 | 3.0 | <0.01 | 2.4 | 0.40 | 0.39 | 0.19 | 0.10 | 0.06 | 0.004 | remaining portion |
| | 5 | 13.9 | 2.9 | <0.01 | 2.1 | 0.36 | 0.38 | 0.19 | <0.01 | 0.05 | 0.004 | remaining portion |
| | 6 | 12.6 | 2.8 | <0.01 | 2.0 | 0.39 | 0.39 | 0.20 | 0.09 | 0.08 | 0.004 | remaining portion |
| | 7 | 13.9 | 2.8 | <0.01 | 2.0 | 0.39 | 0.39 | 0.20 | 0.09 | 0.08 | 0.004 | remaining portion |
| | 8 | 12.6 | 2.8 | <0.01 | 2.0 | 0.37 | 0.38 | 0.24 | 0.08 | 0.05 | 0.004 | remaining portion |
| | 9 | 12.6 | 2.8 | <0.01 | 2.0 | 0.37 | 0.38 | 0.27 | 0.09 | 0.06 | 0.004 | remaining portion |
| | 10 | 12.6 | 2.8 | <0.01 | 2.1 | 0.36 | 0.39 | 0.26 | <0.01 | 0.06 | 0.004 | remaining portion |
| | 11 | 13.6 | 2.9 | <0.01 | 2.1 | 0.40 | 0.40 | 0.22 | <0.01 | <0.01 | 0.004 | remaining portion |
| | 12 | 13.6 | 2.9 | <0.01 | 2.1 | 0.40 | 0.40 | 0.22 | <0.01 | <0.01 | 0.004 | remaining portion |
| | 13 | 13.6 | 2.9 | <0.01 | 2.1 | 0.40 | 0.40 | 0.22 | <0.01 | <0.01 | 0.004 | remaining portion |
| | 14 | 13.8 | 3.0 | <0.01 | 2.4 | 0.40 | 0.39 | 0.19 | 0.10 | 0.06 | 0.004 | remaining portion |
| | 15 | 15.9 | 3.0 | <0.01 | 2.4 | 0.40 | 0.39 | 0.19 | 0.10 | 0.06 | 0.004 | remaining portion |
| | 16 | 13.8 | 3.0 | <0.01 | 2.3 | 0.40 | 0.38 | 0.25 | <0.01 | 0.06 | 0.004 | remaining portion |
| | 17 | 13.8 | 3.0 | <0.01 | 2.3 | 0.40 | 0.38 | 0.25 | <0.01 | 0.06 | 0.004 | remaining portion |
| | 18 | 13.8 | 3.0 | <0.01 | 2.4 | 0.40 | 0.39 | 0.19 | 0.10 | 0.06 | 0.004 | remaining portion |
| | 19 | 13.8 | 3.0 | <0.01 | 2.4 | 0.40 | 0.39 | 0.20 | 0.11 | 0.08 | 0.004 | remaining portion |
| | 23 | 13.0 | 3.0 | <0.01 | 2.0 | 0.40 | <0.01 | 0.20 | <0.01 | 0.06 | 0.001 | remaining portion |
| | 24 | 13.0 | 3.0 | <0.01 | 2.0 | 0.15 | <0.01 | 0.20 | <0.01 | 0.06 | 0.001 | remaining portion |

TABLE 2

| | test material | chemical composition (mass %) | | | | | | | | | | |
|---|---|---|---|---|---|---|---|---|---|---|---|---|
| section | No. | Si | Cu | Mg | Ni | Fe | Mn | Ti | Zr | V | P | Al |
| example | 20 | 12.6 | 2.8 | 0.62 | 2.1 | 0.37 | 0.40 | 0.26 | 0.08 | 0.06 | 0.004 | remaining portion |
| | 21 | 12.6 | 3.0 | 0.64 | 2.3 | 0.40 | 0.40 | 0.20 | 0.08 | 0.06 | 0.004 | remaining portion |
| | 22 | 12.4 | 3.0 | 0.64 | 2.4 | 0.40 | 0.39 | 0.19 | 0.10 | 0.06 | 0.004 | remaining portion |
| | 25 | 12.5 | 2.8 | 0.60 | 2.3 | 0.40 | <0.01 | 0.20 | <0.01 | 0.06 | 0.010 | remaining portion |
| | 26 | 12.5 | 2.8 | 0.60 | 2.3 | 0.15 | <0.01 | 0.20 | <0.01 | 0.06 | 0.010 | remaining portion |

TABLE 3

| | test material | chemical composition (mass %) | | | | | | | | | | |
|---|---|---|---|---|---|---|---|---|---|---|---|---|
| section | No. | Si | Cu | Mg | Ni | Fe | Mn | Ti | Zr | V | P | Al |
| example | 1 | 11.4 | 3.8 | 1.20 | 1.1 | 0.21 | 0.05 | 0.08 | <0.01 | <0.01 | 0.004 | remaining portion |
| | 2 | 14.0 | 2.8 | 0.25 | 2.1 | 0.36 | 0.39 | 0.17 | <0.01 | <0.01 | 0.004 | remaining portion |
| | 3 | 12.6 | 3.0 | 0.61 | 2.4 | 0.37 | <0.01 | 0.11 | 0.08 | 0.06 | 0.004 | remaining portion |
| | 4 | 12.6 | 4.8 | 0.90 | 2.4 | 0.14 | <0.01 | 0.14 | 0.10 | 0.04 | 0.010 | remaining portion |
| | 5 | 12.3 | 3.0 | 0.60 | 2.3 | 0.40 | 0.38 | 0.24 | 0.10 | 0.08 | 0.004 | remaining portion |
| | 6 | 11.8 | 3.2 | 0.72 | 2.3 | 0.37 | 0.01 | 0.10 | 0.10 | 0.06 | 0.004 | remaining portion |

TABLE 4

| section | test material No. | chemical composition (mass %) | | | | | | | | | | |
|---|---|---|---|---|---|---|---|---|---|---|---|---|
| | | Si | Cu | Mg | Ni | Fe | Mn | Ti | Zr | V | P | Al |
| example | 7 | 13.7 | 3.0 | <0.01 | 2.4 | 0.40 | 0.38 | 0.19 | 0.12 | 0.06 | 0.004 | remaining portion |
| | 8 | 13.7 | 3.0 | <0.01 | 2.4 | 0.40 | 0.38 | 0.19 | 0.12 | 0.06 | 0.004 | remaining portion |
| | 9 | 13.8 | 3.0 | <0.01 | 2.3 | 0.40 | 0.39 | 0.19 | 0.10 | 0.06 | 0.004 | remaining portion |

TABLE 5

| section | test material No. | existence and non-existence of Mg | thermal treatment | HV | Nf | inclusion |
|---|---|---|---|---|---|---|
| example | 1 | no Mg | T6 | 112 | 2400 | less than 50 μm |
| | 2 | no Mg | T6 | 108 | 2933 | less than 50 μm |
| | 3 | no Mg | T6 | 112 | 2037 | less than 50 μm |
| | 4 | no Mg | T6 + S | 89 | 3400 | less than 50 μm |
| | 5 | no Mg | T6 + S | 86 | 3280 | less than 50 μm |
| | 6 | no Mg | T6 + S | 82 | 4400 | less than 50 μm |
| | 7 | no Mg | T6 + S | 85 | 3710 | less than 50 μm |
| | 8 | no Mg | T6 + S | 89 | 3316 | less than 50 μm |
| | 9 | no Mg | T6 + S | 90 | 4074 | less than 50 μm |
| | 10 | no Mg | T6 + S | 89 | 4410 | less than 50 μm |
| | 11 | no Mg | T6 + S | 85 | 3605 | less than 50 μm |
| | 12 | no Mg | TS | 84 | 3240 | less than 50 μm |
| | 13 | no Mg | T6 + S4 | 86 | 4045 | less than 50 μm |
| | 14 | no Mg | T5 | 106 | 2002 | less than 50 μm |
| | 15 | no Mg | T5 | 100 | 2252 | less than 50 μm |
| | 16 | no Mg | water cooling T5 | 116 | 2606 | less than 50 μm |
| | 17 | no Mg | F | 105 | 3135 | less than 50 μm |
| | 18 | no Mg | F | 99 | 3000 | less than 50 μm |
| | 19 | no Mg | water cooling T5 + S | 99 | 2096 | less than 50 μm |
| | 23 | no Mg | T6 | 106 | 2600 | less than 50 μm |
| | 24 | no Mg | T6 | 104 | 2200 | less than 50 μm |

TABLE 6

| section | test material No. | existence and non-existence of Mg | thermal treatment | HV | Nf | inclusion |
|---|---|---|---|---|---|---|
| example | 20 | exist | T6 + S | 95 | 2130 | less than 50 μm |
| | 21 | exist | T6 + S | 91 | 2930 | less than 50 μm |

TABLE 6-continued

| section | test material No. | existence and non-existence of Mg | thermal treatment | HV | Nf | inclusion |
|---|---|---|---|---|---|---|
| | 22 | exist | water cooling T5 + S | 99 | 1560 | less than 50 μm |
| | 25 | exist | T6 + S | 90 | 2300 | less than 50 μm |
| | 26 | exist | T6 + S | 89 | 2100 | less than 50 μm |

TABLE 7

| section | test material No. | existence and non-existence of Mg | thermal treatment | HV | Nf | inclusion |
|---|---|---|---|---|---|---|
| example | 1 | exist | T6 | 127 | 1030 | less than 50 μm |
| | 2 | exist | T6 | 151 | 1090 | less than 50 μm |
| | 3 | exist | T5 | 101 | 1285 | less than 50 μm |
| | 4 | exist | T5 | 106 | 418 | less than 50 μm |
| | 5 | exist | T5 | 108 | 778 | less than 50 μm |
| | 6 | exist | water cooling T5 | 132 | 875 | less than 50 μm |

TABLE 8

| section | test material No. | existence and non-existence of Mg | thermal treatment | HV | Nf | inclusion |
|---|---|---|---|---|---|---|
| example | 7 | no Mg | F | 102 | 1160 | 100 μm |
| | 8 | no Mg | F | 102 | 714 | 200 μm |
| | 9 | no Mg | T5 + S | 98 | 1186 | 200 μm |

Next, an example of a piston manufactured using an aluminum cast alloy of the above-described Example 1 and the like is shown.

Figure 4:
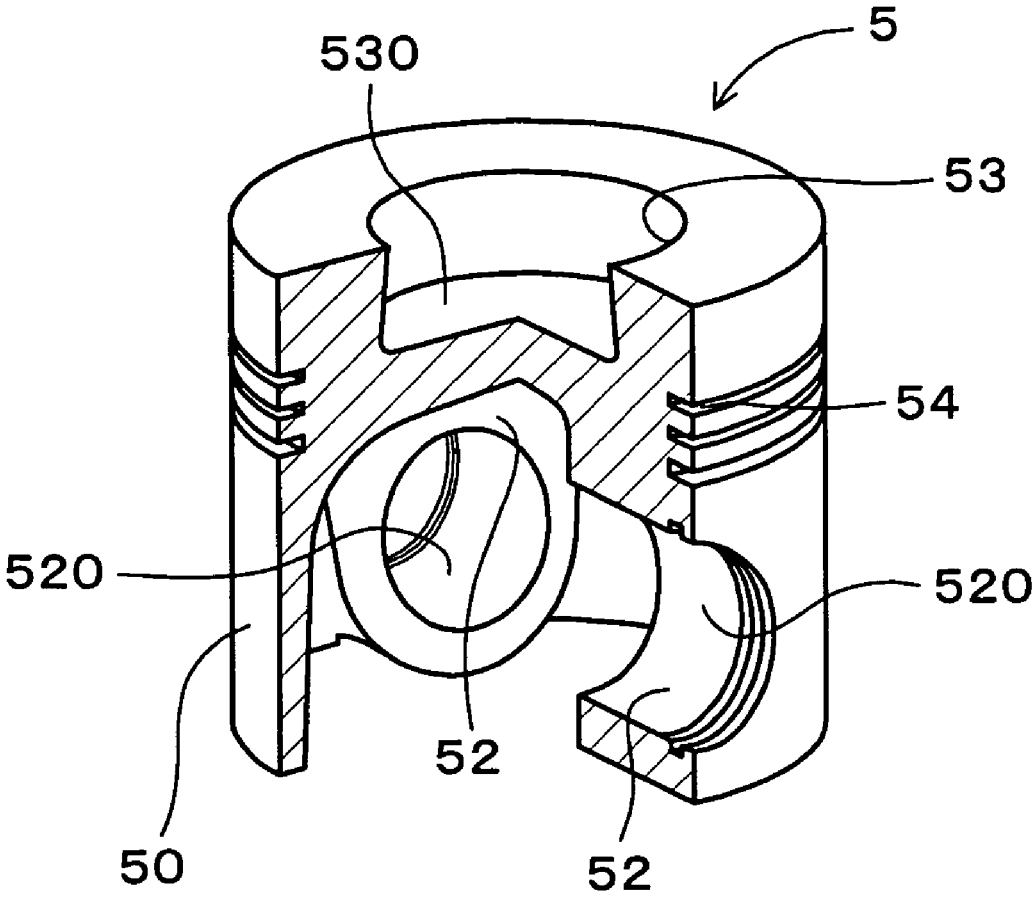
FIG. 4 is a perspective partial cutaway view of a piston in Example 1 of the present invention.

A piston 5 of the present Example includes, as shown in FIG. 4, a main body section 50 in an approximately cylindrical shape, a top face section 530 provided and arranged so as to occlude one end of the relevant main body section 50, and a pin boss section 52 in which a pin hole 520 is provided so as to penetrate through the main body section 50 in a radial direction. Each pin hole 520 is configured so that a piston pin for the purpose of fixing connecting rod (not shown) is inserted.

For the piston 5 manufacturing, the procedure similar to the case where the test pieces of the above-described Examples 1-20 are manufactured can be employed.

Concerning the obtained piston 5, the thermo-mechanical fatigue resistance of the above-described top face section 530 can be particularly enhanced, and especially, the enhancement effect of the thermo-mechanical fatigue resistance of a lip section 53 is significant. Moreover, the fatigue strength at a high temperature of the entire top face section 530 becomes high. By these effects, the durability of the entire piston can be enhanced comparing to the conventional pistons. Moreover, since the present alloy is excellent in heat resistance, the effect can be also expected when the present alloy is used for the purpose of enhancing the heat resistance of a ring groove section 54.

Example 2

In the present Example, as shown in Table 9, Ca (Calcium) has been added as a component of a casting alloy, and the lower limit value of the amount of addition was checked.

As shown in Table 9, in the present Example, two of sample members (Examples A1, A2) has been prepared for Example of the present invention, and two of sample members (Comparative Examples A3, A4) has been prepared for Comparative Example as well. Any of the sample members has been cast by a method of casting similar to the case of Example 1, and subsequently, it has been stood to cool to the level of room temperature.

Figure 5:
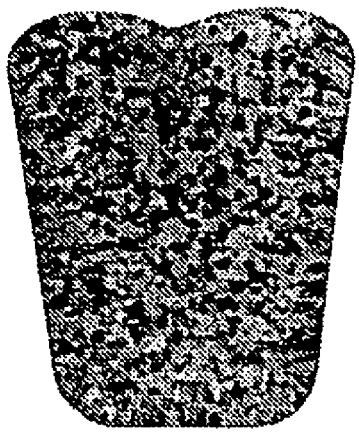
FIG. 5 is a photograph substituting a drawing showing macro-structure of Example A1 in Example 2 of the present invention.
Figure 6:
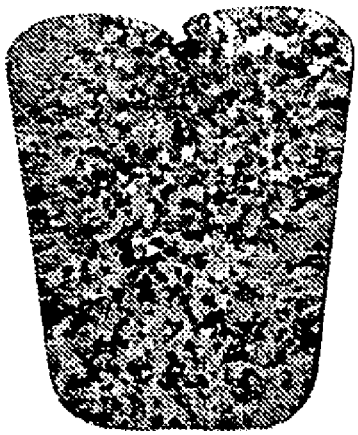
FIG. 6 is a photograph substituting a drawing showing macro-structure of Example A2 in Example 2 of the present invention.
Figure 7:
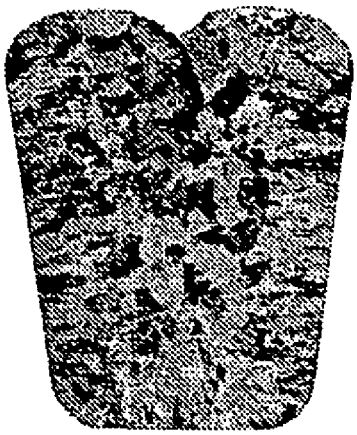
FIG. 7 is a photograph substituting a drawing showing macro-structure of Comparative Example A3 in Example 2 of the present invention.
Figure 8:
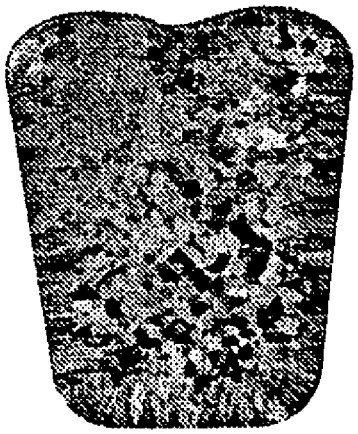
FIG. 8 is a photograph substituting a drawing showing macro-structure of Comparative Example A4 in Example 2 of the present invention.

The macro-structure photographs of the obtained sample members are shown in FIGS. 5-8. FIG. 5 shows a photograph corresponding to Example A1, FIG. 6 shows a photograph corresponding to Example A2, FIG. 7 shows a photograph corresponding to Comparative Example A3, and FIG. 8 shows a photograph corresponding to Comparative Example A4.

As known from FIGS. 5-8, the crystal grain of alloys of Examples A1, A2 in which Ca (Calcium) content is equal to or more than 0.0005 mass % is finer and its structure is more homogenized comparing to those of alloys of Comparative Examples A3, A4 in which Ca (Calcium) content is less than 0.0005 mass %.

It should be noted that the symbol ○ in Table 9 denotes that the structure is fine and homogenized, and the symbol Δ in Table 9 denotes the texture is rather coarse and rather heterogeneous.

TABLE 9

| | | chemical composition (mass %) | | | | | | | | | | | | | | | |
|---|---|---|---|---|---|---|---|---|---|---|---|---|---|---|---|---|---|
| section | sample No. | Si | Cu | Mg | Ni | Fe | Mn | Cr | Ti | B | Zr | V | P | Ca | Be | texture | FIG. |
| example | A1 | 13.8 | 3 | <0.01 | 2.3 | 0.4 | 0.4 | — | 0.2 | — | 0.1 | 0.06 | 0.01 | 0.0012 | — | ○ | FIG. 5 |
| example | A2 | 13.8 | 3 | <0.01 | 2.3 | 0.4 | 0.4 | — | 0.25 | — | 0.1 | 0.06 | 0.01 | 0.0009 | — | ○ | FIG. 6 |
| comparative example | A3 | 13.8 | 3 | <0.01 | 2.3 | 0.4 | 0.4 | — | 0.2 | — | 0.1 | 0.06 | 0.01 | 0.0002 | — | Δ | FIG. 7 |
| comparative example | A4 | 13.8 | 3 | <0.01 | 2.3 | 0.4 | 0.4 | — | 0.25 | — | 0.1 | 0.06 | 0.01 | 0.0003 | — | Δ | FIG. 8 |

Example 3

In the present Example, as shown in Table 10, Ca (Calcium) has been added as a component of a casting alloy, and the upper limit value of the amount of addition has been checked.

As shown in Table 10, in the present Example, one of sample member (Example B1) has been prepared for Example of the present invention, and two of sample members (Comparative Examples B2, B3) have been prepared for Comparative Example as well. Either of the sample members has been cast by a method of casting similar to the case of Example 1, and subsequently, it has been stood to cool to the level of room temperature.

Figure 9:
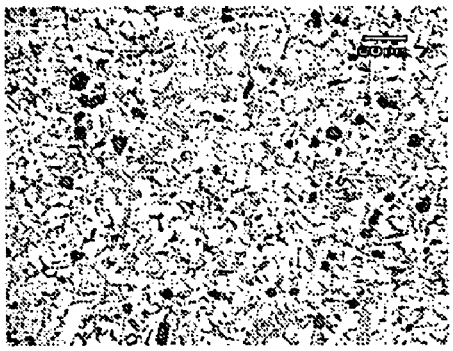
FIG. 9 is a photograph substituting a drawing showing micro-structure of Example B1 in Example 3 of the present invention.
Figure 10:
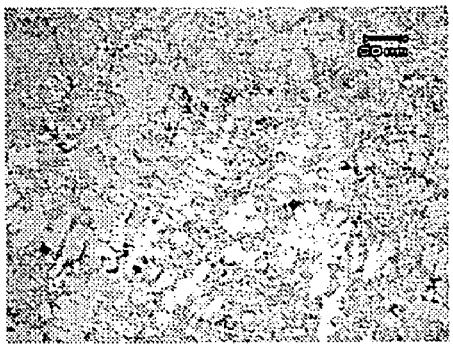
FIG. 10 is a photograph substituting a drawing showing micro-structure of Comparative Example B2 in Example 3 of the present invention.
Figure 11:
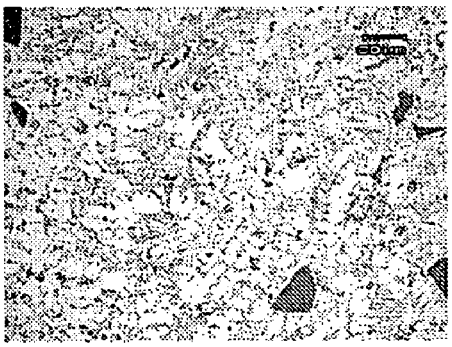
FIG. 11 is a photograph substituting a drawing showing micro-structure of Comparative Example B3 in Example 3 of the present invention.

The micro-structure photographs of the obtained sample members are shown in FIGS. 9-11. FIG. 9 shows a photograph corresponding to Example B1, FIG. 10 shows a photograph corresponding to Comparative Example B2, and FIG. 11 shows a photograph corresponding to Comparative Example B3.

As known from FIGS. 9-11, in alloys of Example B1 in which Ca (Calcium) content is equal to or less than 0.003 mass %, the alignment of dendrites is hardly observed, and the micro-structure is homogenized, however, in alloys of Comparative Examples B2, B3 in which Ca (Calcium) content is more than 0.003 mass %, the alignment of dendrites is clear and the micro-structure is heterogeneous.

It should be noted that the symbol ○ in Table 10 denotes that the texture is homogenized, and the symbol X in Table 10 denotes that the texture is heterogeneous.

TABLE 10

| section | sample No. | chemical composition (mass %) | | | | | | | | | | | | | | texture | FIG. |
|---|---|---|---|---|---|---|---|---|---|---|---|---|---|---|---|---|---|
| | | Si | Cu | Mg | Ni | Fe | Mn | Cr | Ti | B | Zr | V | P | Ca | Be | | |
| example | B1 | 12.9 | 2.81 | 0.57 | 2.48 | 0.36 | 0.36 | — | 0.25 | — | 0.06 | 0.03 | 0.02 | 0.003 | — | ○ | FIG. 9 |
| comparative example | B2 | 12.4 | 2.89 | 0.67 | 2.32 | 0.47 | 0.45 | — | 0.28 | — | 0.1 | 0.1 | 0.01 | 0.004 | — | X | FIG. 10 |
| comparative example | B3 | 12.9 | 2.77 | 0.57 | 2.46 | 0.37 | 0.36 | — | 0.25 | — | 0.06 | 0.03 | 0.02 | 0.0044 | — | X | FIG. 11 |

Example 4

In the present Example, as shown in Table 11, Cr (Chromium) has been added as a component of a casting alloy, and the effect due to the addition of Cr (Chromium) has been checked.

As shown in Table 11, in the present Example, two of sample members (Examples C1, C2) have been prepared for Example of the present invention, and two of sample members (Comparative Examples C3, C4) have been prepared for Comparative Example as well. Any of the sample members has been cast by a method of casting similar to the case of Example 1, and subsequently, it has been stood to cool to the level of room temperature.

Figure 12:
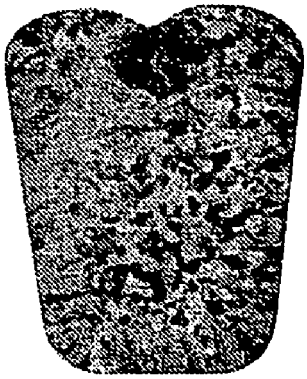
FIG. 12 is a photograph substituting a drawing showing macro-structure of Example C1 in Example 4 of the present invention.
Figure 13:
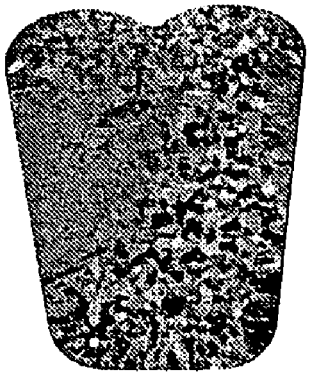
FIG. 13 is a photograph substituting a drawing showing macro-structure of Example C2 in Example 2 of the present invention.
Figure 14:
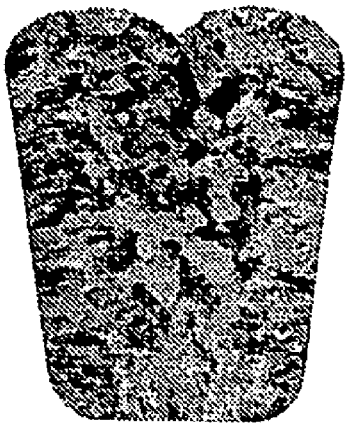
FIG. 14 is a photograph substituting a drawing showing macro-structure of Comparative Example C3 in Example 4 of the present invention.
Figure 15:
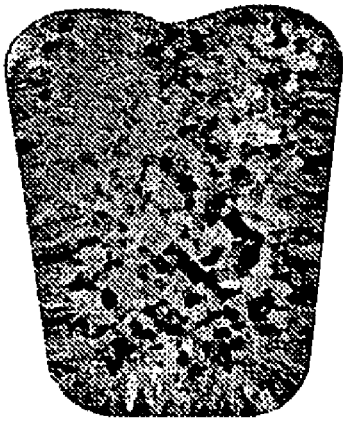
FIG. 15 is a photograph substituting a drawing showing macro-structure of Comparative Example C4 in Example 4 of the present invention.

The macro-structure photographs of the obtained sample members are shown in FIGS. 12-15. FIG. 12 shows a photograph corresponding to Example C1, FIG. 13 shows a photograph corresponding to Example C2, FIG. 14 shows a photograph corresponding to Comparative Example C3 and FIG. 15 shows a photograph corresponding to Comparative Example C4.

As known from FIGS. 12-15, the crystal grain of alloys of Examples C1, C2 containing Cr (Chromium) in which Cr (Chromium) content is equal to or more than 0.01 mass % is fine and its macro-structure is more homogenized comparing to those of alloys of Comparative Examples C3, C4 substantially not containing Cr (Chromium) in which Cr (Chromium) content is less than 0.01 mass %.

It should be noted that the symbol ○ in Table 11 denotes that the texture is sufficiently fine and homogenized, and the symbol Δ in Table 11 denotes that the texture is rather coarse and rather heterogeneous.

Example 5

In the present Example, as indicated in Table 12, the influence generated in the case where B (Boron) is contained as a component of a casting alloy has been checked.

As indicated in Table 12, in the present Example, one of sample member (Example D1) has been prepared for Example of the present invention, and two of sample members (Comparative Examples D2, D3) have been prepared for Comparative Example as well. Any of the sample members has been cast by a method of casting similar to the case of Example 1, and subsequently, after it has been stood to cool to the level of room temperature, the aging treatment has been carried out at 220° C. for 6 hours (T5 treatment), and further, after it has been retained at the temperature of 350° C. for 100 hours, it has been stood to cool to the level of room temperature.

In the present Example, Vickers hardness of the obtained sample members has been measured. The results are indicated in Table 12.

As known from Table 12, as for the hardness of alloy of Example D1 substantially not containing B (Boron) in which B (Boron) content is less than 0.01 mass %, its hardness after retaining at a high temperature is higher and the heat resistance is more excellent comparing to Comparative Examples D2, D3 in which B (Boron) content is equal to or more than 0.01 mass %.

It will also be appreciated that, although a limited number embodiments of the invention have been described in detail for purposes of illustration, various modifications may be made without departing from the spirit and scope of the invention. Accordingly, the invention should not be limited except as by the appended claims.

TABLE 11

| section | sample No. | chemical composition (mass %) | | | | | | | | | | | | | | texture | fig |
|---|---|---|---|---|---|---|---|---|---|---|---|---|---|---|---|---|---|
| | | Si | Cu | Mg | Ni | Fe | Mn | Cr | Ti | B | Zr | V | P | Ca | Be | | |
| example | C1 | 13.5 | 3 | <0.01 | 2.4 | 0.39 | 0.39 | 0.02 | 0.19 | — | 0.12 | 0.06 | 0.01 | 0.0003 | — | ○ | FIG. 12 |
| example | C2 | 13.4 | 2.94 | <0.01 | 2.36 | 0.38 | 0.39 | 0.02 | 0.24 | — | 0.12 | 0.08 | 0.01 | 0.0006 | — | ○ | FIG. 13 |
| comparative example | C3 | 13.8 | 3 | <0.01 | 2.3 | 0.4 | 0.4 | <0.01 | 0.2 | — | 0.1 | 0.06 | 0.01 | 0.0002 | — | Δ | FIG. 14 |
| comparative example | C4 | 13.8 | 3 | <0.01 | 2.3 | 0.4 | 0.4 | <0.01 | 0.25 | — | 0.1 | 0.06 | 0.01 | 0.0003 | — | Δ | FIG. 15 |

TABLE 12

| section | name of alloy | chemical composition (mass %) | | | | | | | | | | | | | | | |
|---|---|---|---|---|---|---|---|---|---|---|---|---|---|---|---|---|---|
| | | Si | Cu | Mg | Ni | Fe | Mn | Cr | Ti | B | Zr | V | P | Ca | Be | texture | HV* |
| example | D1 | 12.5 | 2.8 | <0.01 | 2.3 | 0.4 | 0.4 | — | 0.25 | <0.01 | <0.01 | 0.1 | 0.01 | — | — | — | 90 |
| comparative example | D2 | 13 | 3.2 | <0.01 | 2.3 | 0.4 | 0.4 | — | 0.2 | 0.01 | <0.01 | 0.1 | 0.01 | — | — | — | 83 |
| comparative example | D3 | 12.5 | 3 | <0.01 | 2.3 | 0.4 | 0.4 | — | 0.2 | 0.04 | <0.01 | 0.1 | 0.01 | — | — | — | 81 |

What is claimed is:

1. A piston made of an aluminum cast alloy, wherein the aluminum cast alloy has a hypereutectic structure and comprises:

Mg (Magnesium): 0.2-2 mass %,
Ti (Titanium): 0.15-0.3 mass %,
Si (Silicon): 10-21 mass %,
Cu (Copper): 2-3.5 mass %,
Fe (Iron): 0.1-0.7 mass %,
Ni (Nickel): 1-3 mass %,
P (Phosphorus): 0.001-0.02 mass %,
V (Vanadium): 0.02-0.3 mass %,
Zr (Zirconium): 0.02-0.3 mass %,
Mn (Manganese): 0.2-0.7 mass %,
Ca (Calcium): 0.0005-0.003 mass %,
Al (Aluminum): the remaining portions, and impurities, and wherein pre-use Vickers hardness (Vickers hardness prior to the initiation of use) of the piston is in the range from HV 70 to 100.

2. The piston made of aluminum cast alloy as claimed in claim 1, wherein size of non-metal inclusion existing within the piston is less than 100 μm.

3. A piston made of an aluminum cast alloy, wherein the aluminum cast alloy has a hypereutectic structure and comprises:

Mg (Magnesium): 0.2-2 mass %,
Ti (Titanium): 0.15-0.3 mass %,
Si (Silicon): 10-21 mass %,
Cu (Copper): 2-3.5 mass %,
Fe (Iron): 0.1-0.7 mass %,
Ni (Nickel): 1-3 mass %,
P (Phosphorus): 0.001-0.02 mass %,
V (Vanadium): 0.02-0.3 mass %,
Zr (Zirconium): 0.02-0.3 mass %,
Mn (Manganese): 0.2-0.7 mass %,
Ca (Calcium): 0.0005-0.003 mass %,
Al (Aluminum): the remaining portions, and impurities.

4. The piston made of aluminum cast alloy as claimed in claim 3, wherein size of non-metal inclusion existing within the piston is less than 100 μm.

5. The piston made of an aluminum cast alloy as claimed in claim 1, wherein the aluminum cast alloy consists of:

Mg (Magnesium): 0.2-2 mass %,
Ti (Titanium): 0.15-0.3 mass %,
Si (Silicon): 10-21 mass %,
Cu (Copper): 2-3.5 mass %,
Fe (Iron): 0.1-0.7 mass %,
Ni (Nickel): 1-3 mass %,
P (Phosphorus): 0.001-0.02 mass %,
V (Vanadium): 0.02-0.3 mass %,
Zr (Zirconium): 0.02-0.3 mass %,
Mn (Manganese): 0.2-0.7 mass %,
Ca (Calcium): 0.0005-0.003 mass %,
optionally Cr (Chromium): 0.01-0.5 mass %,
optionally B (Boron): less than 0.01 mass %,
optionally Be (Beryllium): 0.01-0.5 mass %,
Al (Aluminum): the remaining portions, and impurities.

6. The piston made of an aluminum cast alloy as claimed in claim 3, wherein the aluminum cast alloy consists of:

Mg (Magnesium): 0.2-2 mass %,
Ti (Titanium): 0.15-0.3 mass %,
Si (Silicon): 10-21 mass %,
Cu (Copper): 2-3.5 mass %,
Fe (Iron): 0.1-0.7 mass %,
Ni (Nickel): 1-3 mass %,
P (Phosphorus): 0.001-0.02 mass %,
V (Vanadium): 0.02-0.3 mass %,
Zr (Zirconium): 0.02-0.3 mass %,
Mn (Manganese): 0.2-0.7 mass %,
Ca (Calcium): 0.0005-0.003 mass %,
optionally Cr (Chromium): 0.01-0.5 mass %,
optionally B (Boron): less than 0.01 mass %,
optionally Be (Beryllium): 0.01-0.5 mass %,
Al (Aluminum): the remaining portions, and impurities.

7. A method of manufacturing a piston made of aluminum cast alloy, the method comprising:

a casting step of forming a piston by casting aluminum cast alloy which comprises Mg (Magnesium): 0.2-2 mass %, Ti (Titanium): 0.15-0.3 mass %, Si (Silicon): 10-21 mass %, Cu (Copper): 2-3.5 mass %, Fe (Iron): 0.1-0.7 mass %, Ni (Nickel): 1-3 mass %, P (Phosphorus): 0.001-0.02 mass %, V (Vanadium): 0.02-0.3 mass %, Zr (Zirconium): 0.02-0.3 mass %, Mn (Manganese): 0.2-0.7 mass %, Ca (Calcium): 0.0005-0.003 mass %, Al (Aluminum): the remaining portions and impurities, an annealing step of retaining the piston at a temperature of 250-400° C. for 0.5-24 hours in order to make that pre-use Vickers hardness of the piston in the range from HV 70 to 100, a cutting step of providing a cutting operation to the piston prior to or after the annealing step, and producing the piston made of aluminum cast alloy of claim 1.

8. The method of manufacturing a piston made of aluminum cast alloy as claimed in claim 7, wherein after the casting step is carried out, a solution heat treatment step of retaining the piston at a temperature of 450-510° C. for 1-12 hours is carried out, then, a quenching step of rapidly cooling the piston is provided, and subsequently, the annealing step is carried out.

9. The method of manufacturing a piston made of aluminum cast alloy as claimed in claim 8, wherein after the quenching step is carried out, an aging step of retaining the piston at a temperature of 180-280° C. for 1-12 hours is provided, and subsequently, the annealing step is carried out.

* * * * *